United States Patent [19]

Renshaw

[11] 4,280,056

[45] Jul. 21, 1981

[54] PROTECTIVE SHIELD FOR ARTHROGRAMS

[76] Inventor: Governor K. Renshaw, 14448 Merced St., San Leandro, Calif. 94579

[21] Appl. No.: 89,511

[22] Filed: Oct. 30, 1979

[51] Int. Cl.[3] ..... G21C 11/00; G21F 3/02

[52] U.S. Cl. ..... 250/515; 250/519

[58] Field of Search ..... 250/515, 516, 519

[56] References Cited

U.S. PATENT DOCUMENTS

| | | | |
|---|---|---|---|
| 1,907,523 | 5/1933 | Egress | 250/515 |
| 3,308,297 | 3/1967 | Mansker | 250/515 |
| 3,448,266 | 6/1969 | Bucky et al. | 250/515 |
| 3,883,749 | 5/1975 | Whittaker et al. | 250/519 |
| 3,984,696 | 10/1976 | Collica et al. | 250/519 |
| 4,156,146 | 5/1979 | Imai et al. | 250/515 |

*Primary Examiner*—Bruce C. Anderson

*Attorney, Agent, or Firm*—Alvin E. Hendricson

[57] ABSTRACT

An adjustably positioned X-ray shield for an X-ray table has viewing means through a flexible shield element with a removable flexible lower portion and flexible removable hand shields for protection of a radiologist or the like during x-ray diagnosis or treatment requiring patient manipulation such as knee arthrograms and spinal myelograms.

6 Claims, 5 Drawing Figures

PROTECTIVE SHIELD FOR ARTHROGRAMS

BACKGROUND OF INVENTION

The destructive effect of X-rays on living cells has long been known and with the widespread use of X-ray diagnostic and treatment procedings and equipment there have been developed many types of protective devices for operators of X-ray equipment. Modern X-ray diagnosis has rapidly expanded from relatively simple dental and bone X-rays to complex diagnostic techniques employing radiographic dies as in the crystoscopic examination of the urinary tract or in knee arthrograms and spinal myelograms. Such procedures require a specialist or physician to be close to or in actual contact with the patient during X-ray diagnoses and thus subject to repeated exposure to secondary and stray radiation. U.S. Pat. No. 3,308,297 shows a shield accommodating the passage of instruments and U.S. Pat. No. 3,984,696 shows a shield penetrable by the hands of an operator to reposition or examine a patient between actual X-ray tube operation. Radiation shields are shown in U.S. Pat. No. 2,640,937 to Munday and U.S. Pat. No. 4,020,346 to Dennis, for example, and various types of X-ray shielding systems and devices are shown in Caldwell (U.S. Pat. No. 931,034), Mort (U.S. Pat. No. 3,030,508), Buckey (U.S. Pat. No. 3,448,266), Sweeney (U.S. Pat. No. 3,903,425) and Collica (U.S. Pat. No. 3,984,696) for example. Many problems of shielding arising from new X-ray techniques remain to be solved.

SUMMARY OF INVENTION

The present invention provides a highly advantageous X-ray shield for a diagnostic table and has only a few relatively simple parts including a stand adapted for adjustable positioning on a diagnostic table. An upper flexible X-ray shield or sheet depends from the stand and has a viewing window therein. The flexible shield is laced to the upright portion of the stand and preferrably terminates in spaced relation above the table. The stand may be movebly mounted across the table or along a side thereof.

It is known that lead aprons, lead gloves and lead glass eyeglasses are available for radiologists and the like; however, only the first of these is commonly employed because of the cumbersome nature thereof and yet the eyes and thyroid of a person are possibly the most susceptible of the body organs to damage by radiation. The present invention particularly protects the portion of a radiologist or the like above a lead apron and in close proximity to a patient from secondary and stray radiation.

The present invention also includes a lower flexible shield or sheet removably attached to the upper sheet to depend therefrom to a table top and a pair of flexible hand shields with hand straps thereon are removably attached to the bottom of the lower sheet. These additional shields protect an operator of the invention from secondary and stray radiation under circumstances of such operator necessarily contacting a patient during the time the X-ray beam is turned on. It is possible for a physician to grasp the ankle and/or lower leg of a patient on a diagnostic table under an X-ray machine and manipulate the knee joint while viewing the picture on a closed circuit television screen showing the X-ray picture to be taken and yet be protected from secondary and stray radiation. When it is considered that a physician specializing in this type of examination may necessarily perform the foregoing manipulation many times for each of a number of patients each day, it will be appreciated that the present invention is highly advantageous.

The present invention additionally includes protective covers for the lead glass window hereof with such covers being removably attached to opposite sides of the upper sheet over the window. It is known that untempered lead glass is quite brittle and is thus quite easily broken. It is also known that lead glass is quite expensive and the above-noted covers are thus adapted for attachment primarily when the shield of this invention is removed from a diagnostic table and possible stored by hanging on a wall during nonuse.

DESCRIPTION OF FIGURES

The present invention is illustrated with respect to a single preferred embodiment thereof in the accompanying drawing wherein.

DESCRIPTION OF PREFERRED EMBODIMENT

Figure 1:
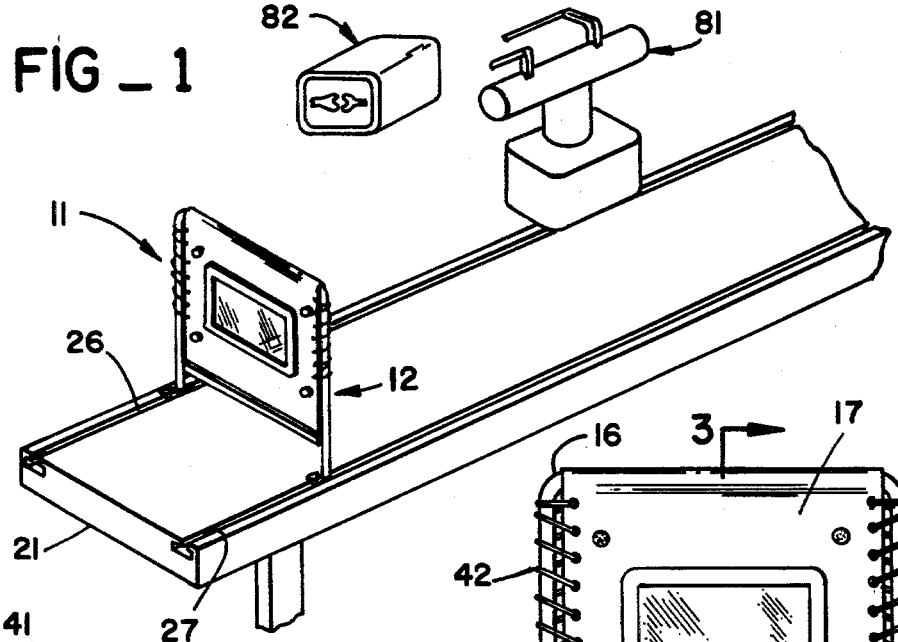
FIG. 1 is a partial perspective view of the present invention in use on a diagnostic table with an X-ray unit above same and a television monitor depicting the "picture" that will be recorded on X-ray film.

The radiation shield 11 of the present invention as illustrated in the accompanying drawings will be seen to include an inverted U-shaped frame or stand 12 having vertical spaced apart legs 13 and 14 and a horizontal upper cross piece 16. A lead rubber shield or sheet 17 depends from the cross piece 16 between the legs 13 and 14 and there is provided a lead glass window 18 in this sheet 17. The frame or stand is adapted to fit onto an X-ray diagnostic table 21 in adjustable and moveable relationship thereto. A pair of feet 22 and 23 are attached one to the bottom of each of the legs 13 and 14, respectively as by threaded engagement therewith so as to be angularly adjustable. The feet 22 and 23 are adapted to be slidably disposed in reentrant or T slots 26, 27 extending along the sides of the top of the table 21. These slots may be built into the table or provided in strips attached to the table. The feet 22 and 23 may be identical and the foot 23, for example, will be seen to include a flat plate 31 having a threaded stud 32 extending upwardly therefrom for threaded engagement with the bottom of the leg 14. Preferrably there is also provided a thumb screw 33 threaded vertically through the plate and extending sufficiently upward so as to be accessible for turning by hand to lock the foot in desired position in the track on table 21.

The flexible shield or sheet 17 has an upper fold or loop 41 which extends about the cross piece 16 of the frame for hanging the sheet therefrom and the sides of the sheet 17 are laced to the upright legs 13 and 14 of the frame by laces 42 and 43 extending through grommets along the sides of the sheet. With this manner of mounting it is possible for an operator to loosen the laces in order to swing the lower portion of the shield upwardly if such may be desired for particular applications of the present invention.

Figure 3:
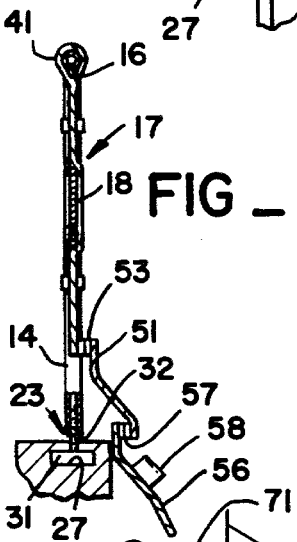
FIG. 3 is a sectional view taken in the plan 3—3 of FIG. 2.

The lead glass window 18 is affixed to the sheet 17 about the edges of the window as by an adhesive with a strip of lead rubber adhered to the sheet 17 and window 18 about the letter, as illustrated in FIG. 3. Across the bottom of sheet 17 on the outer side thereof there is provided attachment means for removably securing a lower shield 51 in depending relationship to the sheet 17. This structure is illustrated in FIG. 3 and the attachment means may comprise a Velcro strip 52 on the sheet 17 and an opposite type Velcro strip 53 on the shield 51. This lower shield 51 is also formed of lead rubber sheet and is adapted to extend the shield at least down to and below the upper surface of the table 21 upon which the present invention is mounted. The purposes of this lower shield are further discussed below. It is also noted that Velcro material is commercially available in what is generally termed male and female parts for the removeable attachment of one piece of cloth to another, for example, and these strips may be attached to their respective shield portions by a suitable adhesive.

Figure 4:
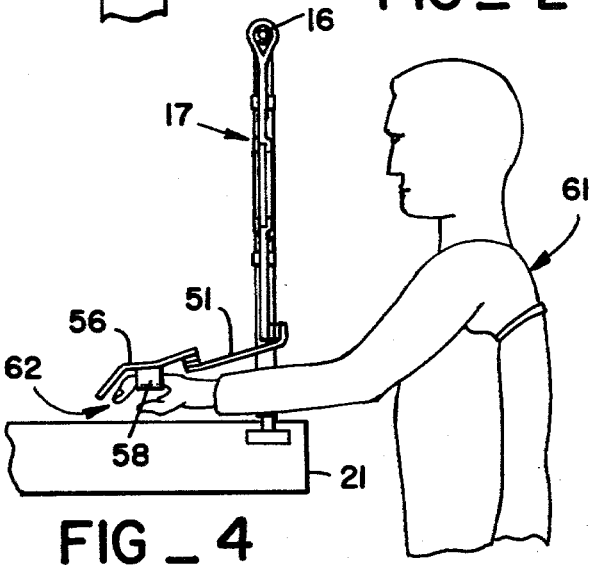
FIG. 4 is a schematic representation of the present invention in use by a radiologist, for example, and taken in substantially the same plane as FIG. 3.

The present invention incorporates one or two flexible hand shields 56 also formed of flexible lead rubber sheet and adapted to be attached to the bottom edge of the lower shield 51 in depending relationship thereto. Removeable attachment of the hand shield or shields to the lower shield 51 may be provided for by a pair of Velcro strips 57 attached one to the lower shield 51 and one across the top of the hand shield or shields 56. These hand shields are provided for the purpose of protecting the hands of a radiologist, for example, under circumstances wherein such a person must or desires to place his hands on the diagnostic table 21 during actual X-raying of a patient. To this end each of the hand shields 56 are provided with a strap 58 on the under surface thereof, as illustrated in FIG. 3 so that an operator or the like may place his hand through the strap from above so that the strap would then extend across the palm of the hand leaving the thumb and fingers free to grasp a patient, for example. The aforegoing is illustrated in FIG. 4, wherein an operator 61 is shown to have placed his hand 62 through the strap 58 on the hand shield 56 and to have reached onto the table 21 as for the purpose of grasping and possibly manipulating a person thereon at or during X-ray diagnosis of such person. It will be seen from FIG. 4 that the operator 61 stands on the opposite side of the present invention from the table 21 so as to be protected from stray X-rays or secondary radiation and yet with the present invention is able to safely reach onto the table for any desired purpose while yet being protected by the present invention. The lower shield 51 additionally protects the arms and lower body of the operator 61 during such an operation. It will be appreciated that the lower shield 51 and/or the hand shield or shields 56 need only be employed for certain applications of the present invention, as determined by the person employing the present invention.

Figure 5:
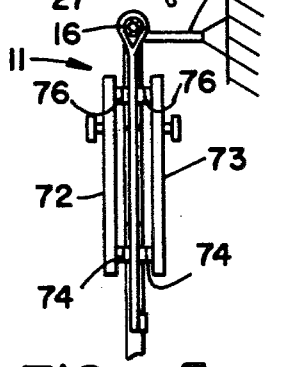
FIG. 5 is a schematic representation of the present invention with the upright removed and having window guards in place for periods of non-use of the present invention.

The lead glass window 18 of the present invention is particularly vulnerable to damage from any blow that may be applied thereto. Although the window is in little danger of being struck during normal usage of the radiation shield thereof, it may well be vulnerable to contact with other elements when the shield is removed from the table 21 and stored. The present invention thus provides protective means for the window and reference is made to FIG. 5 of the drawings illustrating the present invention 11 as being hung on hooks 71 which may be mounted on a wall, for example. The ends of the cross piece 16 may be placed over the hooks for storage of the radiation shield hereof in an out of the way place when not in use. Prior to any movement of the shield from a diagnostic table it is preferrable that the window 18 be protected against inadvertant contact with other elements and protective plates 72 and 73 are shown to be provided for this purpose. Upon both surfaces of the sheet 17 there are provided attachment means for removably mounting the plates 72 and 73 and these may comprise Velcro pads 74 secured to the sheet, as by adhesive, and a mating Velcro pad 76 secured to the plates 72 and 73, as by adhesive. The plates 72 and 73 may be provided with knobs as indicated for readily handling the plates and these plates are formed of a rigid material such as wood or metal and overlie the window 18 on both sides thereof to thus fully protect the window 18. It is noted that the pads 74 on the sheet 17 are disposed in alignment on opposite sides of the sheet so that the plates are actually mounted on the same lines through the sheet to prevent inadvertant bending of the sheet at the window 18 with the plates secured on opposite sides of the sheet.

Figure 2:
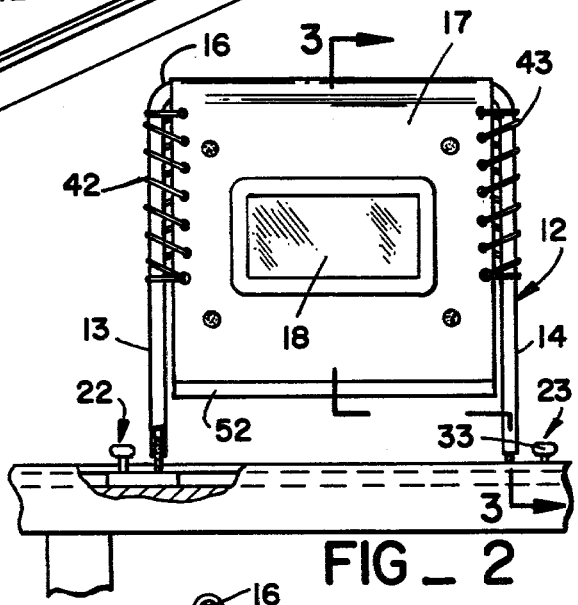
FIG. 2 is a front elevational view of the present invention adjustably mounted on a side of a diagnostic table.

The present invention is adapted to be employed with a diagnostic table 21 as briefly noted above and generally illustrated in FIGS. 1 and 2 of the drawings. The shield is adapted to be mounted in the tracks 26 and 27 on the top of the table to extend laterally across the table, as shown in FIG. 1, or alternatively may be mounted in only one of the tracks to extend longitudinally of the table, as indicated in FIG. 2. An X-ray tube and collimator 81 is shown in FIG. 1 to be disposed above the table 21 for directing an X-ray beam onto a patient disposed on the table. A doctor or technician who may be employing the equipment to produce a knee arthrogram or spinal myelogram, for example, may stand at the end of or the side of the table with the patient disposed thereon and the shield of the present invention will protect such a person from stray X-rays and secondary radiation. If the doctor or technician is manipulating the patient, for example, he may view the picture to be taken, i.e., the X-ray, on a closed-circuit TV monitor 82 to determine that the patient is in the right position and then either operate the X-ray equipment or instruct an operator to actuate the equipment. It will be seen that the upper sheet 17 particularly protects the portion of the doctor or technician 61 above a lead apron that would normally be worn by such a person. Thus the eyes and thyroid, in particular, are especially protected by the present invention. The additional shielding elements 51 and 56 serve to provide the added capability of reaching onto the table and grasping a patient in relatively close proximity to the X-ray beam to be directed on the patient, while yet protecting the doctor or technician from stray X-rays and secondary radiation. It is noted that for various X-rays the table 21 may be tilted and the locking means 33 on the present invention prevents the shield hereof from sliding along the table while it is tilted. For certain types of X-rays the shield would be disposed across a portion of the patient. Under such circumstances the upper shield 17 is all that is required. For other types of X-rays the shield should extend downwardly at least to the top of the table, and under these circumstances the lower shield 51 is attached. The hand shields 56 are only employed under those particular circumstances where the doctor, for example, must reach onto the table and grasp the patient to place a joint, for example, in particular arrangement for diagnosis.

The X-ray shield of the present invention is only directed to the protection of radiologists or the like from repeated doseages of stray X-rays or secondary radiation during actuation of X-ray tubes. It is known that lead rubber is not effective to prevent transmission of direct X-rays, although a lead glass window may be so effective. Thus the present invention should not be employed as a protection of the human body from the effects of a primary X-ray beam.

The present invention has been described above with respect to a single preferred embodiment thereof; however, it will be apparent to those skilled in the art that numerous modifications and variations are possible within the spirit and scope of the present invention and thus it is not intended to limit the invention to the precise details of illustration or terms of description of the present patent application.

What is claimed is:

1. An X-ray shield for protecting an operator physically gripping a patient upon an X-ray table during irradation and adapted for removable attachment to a diagnostic table comprising:

a frame having vertical legs depending from a horizontal cross piece;

a pair of feet connected one to the bottom of each said legs in angularly adjustable relation thereto and being adapted for slidable engagement with at least one of two tracks extending along the top of said table for mounting said frame in adjustable position on said table in extension above the table;

an upper sheet of flexible radiation resistance material depending from said crosspiece between said legs with a lead glass window therein, and removably attached to said legs for protecting said operator standing on the opposite side of said shield from the table from stray X-rays and secondary radiation; a lower sheet of flexible radiation resistant material having attachment means along the top thereof adapted to cooperate with attachment means along the bottom of said upper sheet for removably engaging said sheets in overlapping relation whereby said lower sheet is free to move about the top thereof for extension over said table to protect the hands of said operator thereat.

2. The shield of claim 1 further defined by laces separately adapted for extension through spaced openings along a side of said upper sheet and about one of said frame legs for lacing a side of the sheet to a leg as the removable attachment of sheet and legs.

3. The shield of claim 1 further defined by said tracks on said table including inverted T shaped slots in said table top extending longitudinally of the table along opposite sides thereof and said feet comprising plates adapted for captive slidable disposition in a track slot beneath the upright portion of the slot and each of said feet having an upright portion rotatably engaging the bottom end of a leg through said slots whereby said feet are angularly adjustable to slidably engage separate tracks with the frame across the top of the table and to slidably engage a single track with the frame above the table top along one side thereof.

4. The shield of claim 3 further defined by locking means extending substantially vertically in threaded engagement through a foot plate for locking the position of said frame on said table.

5. The shield of claim 1 further defined by each of said feet having an elongated configuration with an upright element threadably engaging a leg and at least one of said feet having locking means thereon for engaging a track to lock the foot and thus the frame position.

6. The shield of claim 1 further defined by at least one hand shield formed of flexible radiation shielding material with a hand strap mounted on a first side thereof and mating attachment means on the top thereof and on the bottom of said second sheet for removably engaging said hand shield and bottom sheet with said strap disposed on the opposite side of said hand shield from the side normally facing X-rays.

* * * * *